US009484670B2

(12) United States Patent
Ebisawa

(10) Patent No.: US 9,484,670 B2
(45) Date of Patent: Nov. 1, 2016

(54) CONNECTOR ASSEMBLY WITH ENABLING CONTACT AND HOUSING STRUCTURE

(71) Applicant: JAPAN AVIATION ELECTRONICS INDUSTRY, LIMITED, Shibuya-ku, Tokyo (JP)

(72) Inventor: Takeshi Ebisawa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/743,462

(22) Filed: Jun. 18, 2015

(65) Prior Publication Data

US 2016/0036163 A1 Feb. 4, 2016

(30) Foreign Application Priority Data

Jul. 29, 2014 (JP) ..... 2014-153435

(51) Int. Cl.
*H01R 13/627* (2006.01)
*H01R 13/639* (2006.01)
(Continued)

(52) U.S. Cl.
CPC ..... *H01R 13/639* (2013.01); *H01R 13/436* (2013.01); *H01R 13/506* (2013.01); *H01R 13/6273* (2013.01)

(58) Field of Classification Search
CPC ..... H01R 13/639
USPC ..... 439/188, 358
See application file for complete search history.

(56) References Cited

U.S. PATENT DOCUMENTS 5,643,009 A * 7/1997 Dinkel ..... H01R 13/424 439/595
5,895,285 A 4/1999 Okabe
(Continued)

FOREIGN PATENT DOCUMENTS

EP 1523070 A1 4/2005
JP 2593897 Y2 4/1999
(Continued)

OTHER PUBLICATIONS

Extended European Search Report dated Oct. 19, 2015, issued in counterpart European Application No. 15176916.3.

*Primary Examiner* — Tulsidas C Patel
*Assistant Examiner* — Peter G Leigh
(74) *Attorney, Agent, or Firm* — Holtz, Holtz & Volek PC

(57) ABSTRACT

A connector is mateable with a mating connector which has a mating lock portion. The connector comprises a first housing, a second housing and a contact. The first housing accommodates, at least in part, the contact. The contact is provided with a cable holding portion which holds an end of a cable so that the cable extends in a predetermined direction. The second housing is attached to the first housing to hold the contact in cooperation with the first housing. The second housing is provided with a hooked portion, a spring portion, an operation portion and a lock portion. The spring portion is resiliently deformable. The operation portion and the lock portion are supported by the spring portion. The lock portion locks the mating lock portion when the connector and the mating connector are mated with each other. The hooked portion is a portion which is hooked by a finger upon operation of the operation portion. The hooked portion is positioned apart from the operation portion in the predetermined direction. The operation portion releases a lock of the lock portion against the mating lock portion when operated to be moved toward the hooked portion.

8 Claims, 10 Drawing Sheets

(51) Int. Cl.
*H01R 13/436* (2006.01)
*H01R 13/506* (2006.01)

(56) References Cited

U.S. PATENT DOCUMENTS 5,993,230 A * 11/1999 Gauker ..... H01R 13/7032 200/51.1
6,203,342 B1 * 3/2001 Gauker ..... H01R 13/7032 439/188
6,435,894 B2 * 8/2002 Little ..... H01R 13/7032 439/188
6,743,051 B2 * 6/2004 Hayashi ..... H01R 13/719 439/352
6,799,999 B2 * 10/2004 Williamson ..... H01R 13/7195 439/620.01
6,964,579 B2 * 11/2005 Seminara ..... F42B 3/26 439/188
7,004,778 B2 * 2/2006 Barker ..... H01R 13/631 439/352
7,121,892 B2 * 10/2006 Johannes ..... H01R 13/7197 439/620.07
7,207,832 B2 * 4/2007 Liu ..... H01R 9/03 439/499
7,264,496 B2 * 9/2007 Wu ..... H01R 13/6275 439/358
7,354,310 B1 4/2008 Brown
2002/0009918 A1 * 1/2002 Banas ..... H01R 24/58 439/404
2005/0079770 A1 * 4/2005 Shindo ..... H01R 13/6277 439/686

FOREIGN PATENT DOCUMENTS

JP 2000182716 A 6/2000
JP 2001135412 A 5/2001
JP 2001357900 A 12/2001
JP 2005259435 A 9/2005
JP 2009004247 A 1/2009
JP 2013152841 A 8/2013
WO 9807213 A2 2/1998

* cited by examiner

CONNECTOR ASSEMBLY WITH ENABLING CONTACT AND HOUSING STRUCTURE

CROSS REFERENCE TO RELATED APPLICATIONS

An applicant claims priority under 35 U.S.C. §119 of Japanese Patent Application No. JP2014-153435 filed Jul. 29, 2014.

BACKGROUND OF THE INVENTION

This invention relates to a connector which is connected with a cable.

JP-A 2009-4247 (Patent Document 1) discloses a connector 900 which is connected with a cable 970 and which is mated with a mating connector 950 in a mating direction. With reference to FIG. 17, the connector 900 of Patent Document 1 comprises a housing 910 and a contact 920. The housing 910 is provided with a lock portion 912 and an operation portion 914. The mating connector 950 of Patent Document 1 is provided with a mating lock portion 952. When the connector 900 is mated with the mating connector 950, the lock portion 912 locks the mating lock portion 952. When the operation portion 914 is operated, a lock of the lock portion 912 against the mating lock portion 952 is released. The contact 920 is connected with the cable 970. The cable 970 extends in a perpendicular direction perpendicular to the mating direction of the connector 900 and the mating connector 950. The perpendicular direction is a Z-direction. The mating direction is an X-direction.

A structure of the connector 900 of Patent Document 1 has a drawback that it is difficult to connect the cable 970 with the contact 920 and to assemble the housing 910 and the contact 920 connected with the cable 970.

In addition, there is a need that, in a state where a plurality of connectors are mated with a plurality of mating connectors and are arranged in a row, one of the connectors is released from the mating connector corresponding thereto while remaining connectors or cables connected to the remaining connectors do not obstruct the release operation.

SUMMARY OF THE INVENTION

It is therefore an object of the present invention to provide a connector having a structure which enables easy assembly of a housing and a contact connected with a cable and which is capable of satisfying the aforementioned need.

One aspect (first aspect) of the present invention provides a connector mateable with a mating connector which has a mating lock portion. The connector comprises a first housing, a second housing and a contact. The first housing accommodates, at least in part, the contact. The contact is provided with a cable holding portion which holds an end of a cable so that the cable extends in a predetermined direction. The second housing is attached to the first housing to hold the contact in cooperation with the first housing. The second housing is provided with a hooked portion, a spring portion, an operation portion and a lock portion. The spring portion is resiliently deformable. The operation portion and the lock portion are supported by the spring portion. The lock portion locks the mating lock portion when the connector and the mating connector are mated with each other. The hooked portion is a portion which is hooked by a finger upon operation of the operation portion. The hooked portion is positioned apart from the operation portion in the predetermined direction. The operation portion releases a lock of the lock portion against the mating lock portion when operated to be moved toward the hooked portion.

In the present invention, a member which holds the contact is separated into two portions of the first housing and the second housing. After the contacts is, at least in part, accommodated in the first housing, the second hosing is attached to the first housing so that the second housing holds the contact in cooperation with the first housing. Therefore, the connector can be fabricated easily even if the contact is connected with the cable.

The operation portion and the hooked portion are positioned apart from each other in an extending direction in which the cable extends, wherein the hooked portion is hooked by a finger upon operation of the operation portion, and the extending direction is the predetermined direction. Accordingly, in a state where a plurality of the connectors are mated with a plurality of the mating connectors and are arranged in a row, one of the connectors can be easily released from the mating connector corresponding thereto while the remaining connectors or the cables connected to the remaining connectors do not obstruct the release operation.

Figure 1:
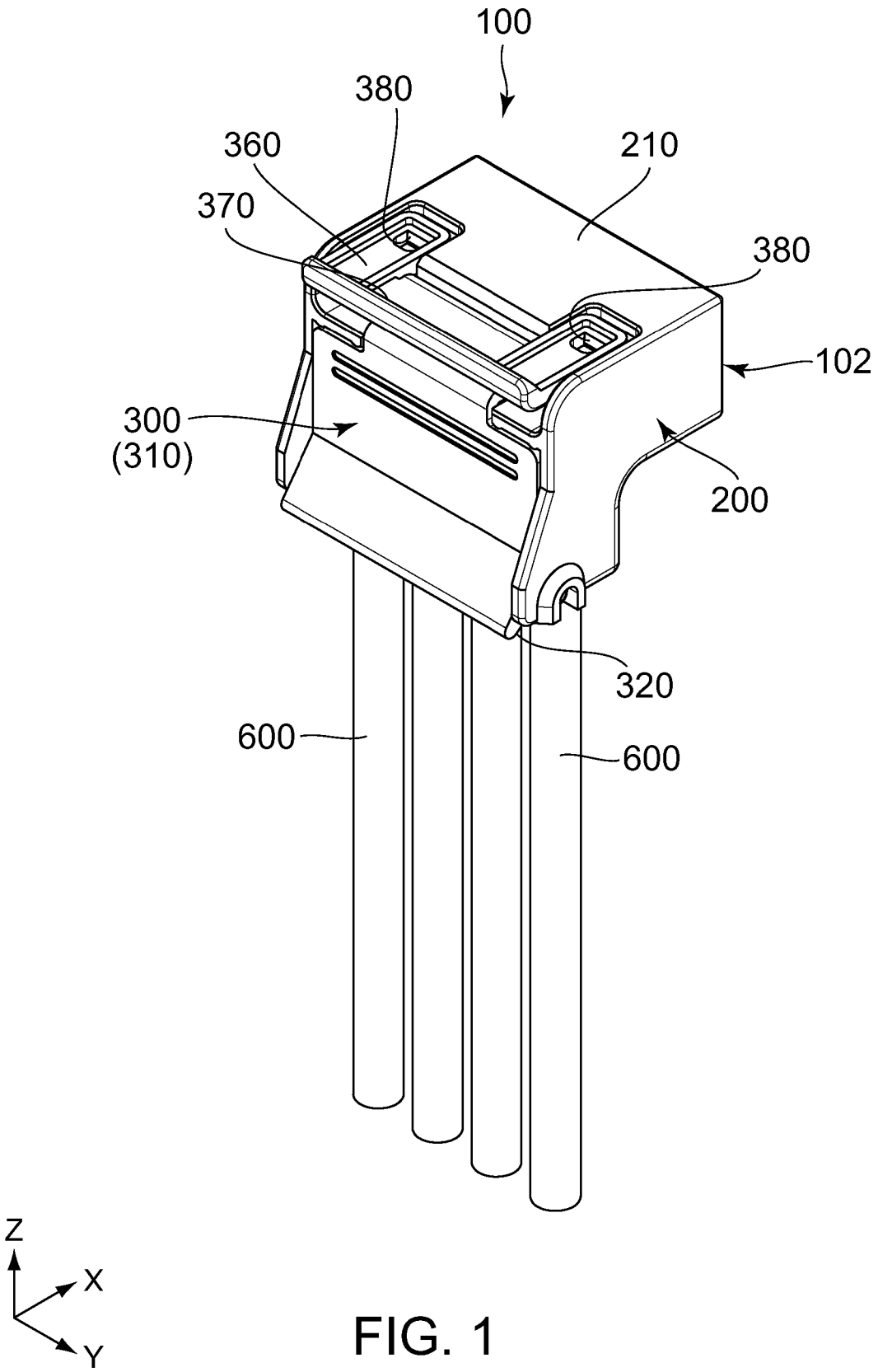
FIG. 1 is a rear, perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 12:
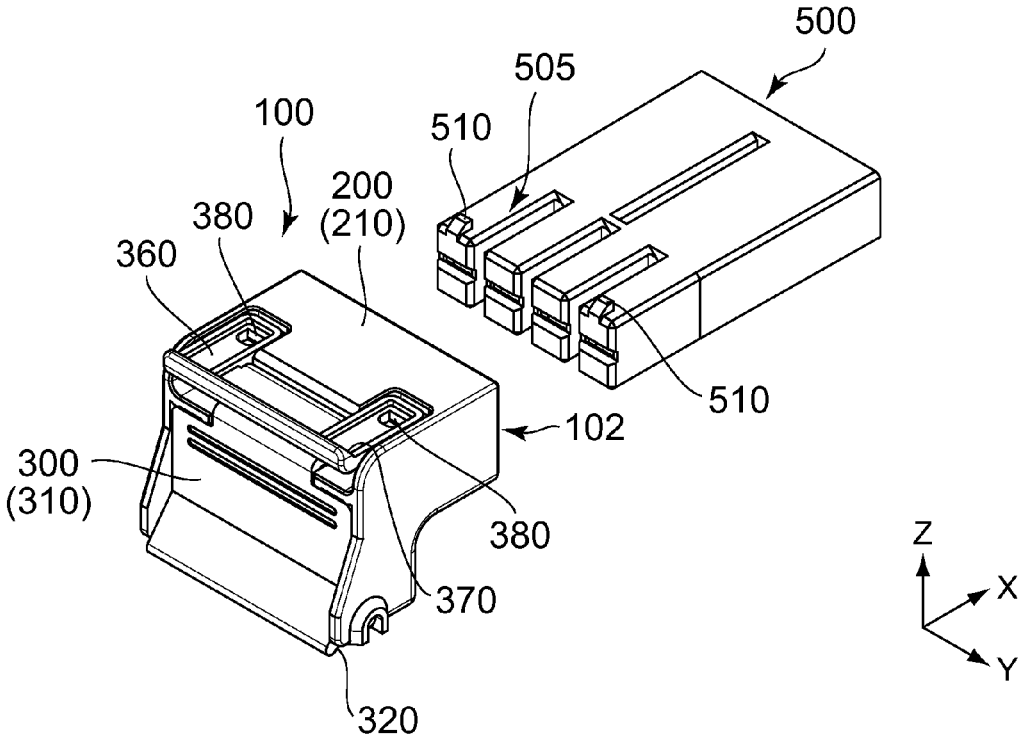
FIG. 12 is a perspective view showing the connector of FIG. 1 and a mating connector. The connector and the mating connector are in an unmated state.
Figure 13:
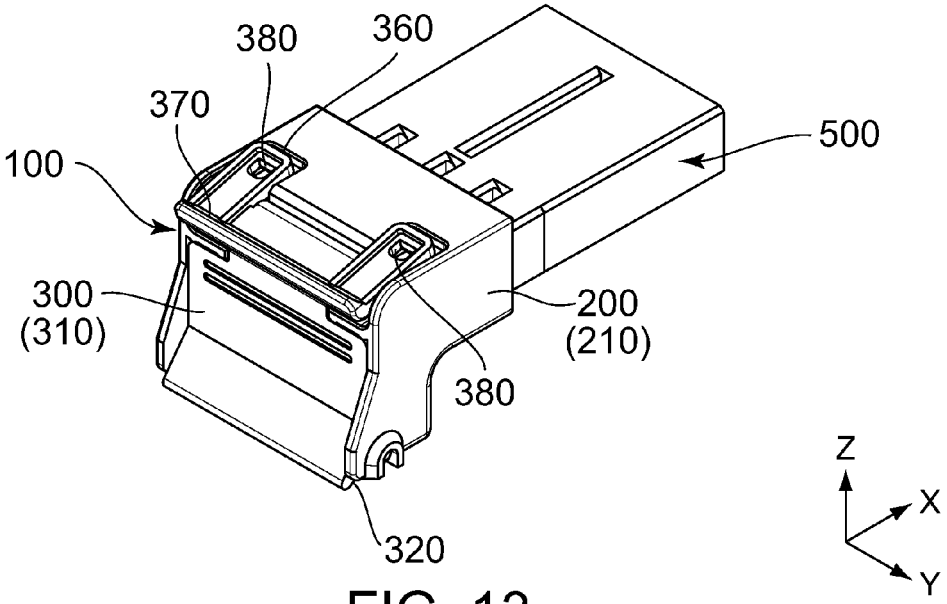
FIG. 13 is another perspective view showing the connector and the mating connector of FIG. 12. The connector and the mating connector are in a state following the state of FIG. 12.
Figure 14:
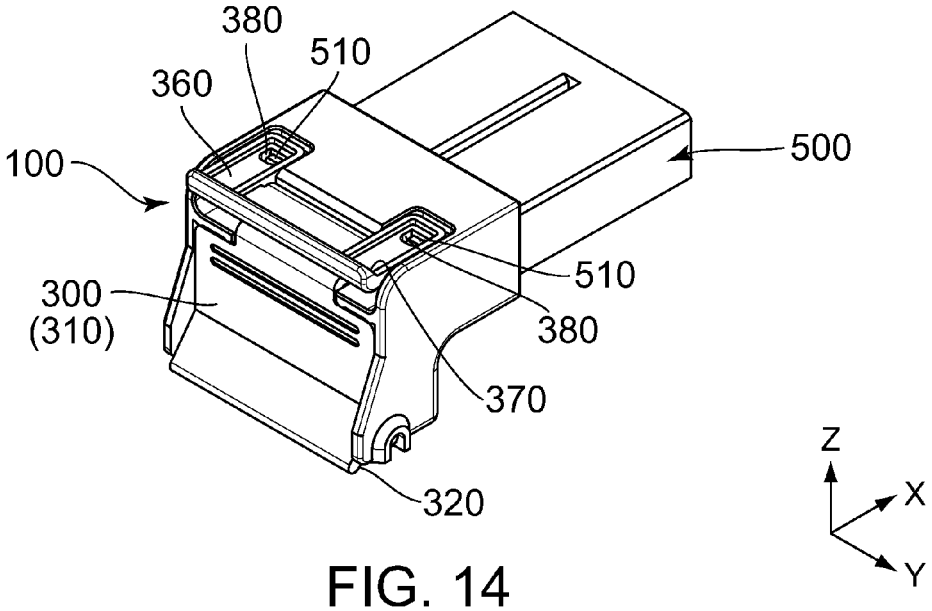
FIG. 14 is still another perspective view showing the connector and the mating connector of FIG. 12. The connector and the mating connector are in a mated state.

As shown in FIGS. 1, 4, 5, 7 and 8, a connector 100 according to an embodiment of the present invention is connected with cables 600. Each of the cables 600 which is connected with the connector 100 extends in a predetermined direction or a Z-direction. In the present embodiment, the predetermined direction is an up-down direction. As shown in FIGS. 12 to 14, the connector 100 is mateable with a mating connector 500 along a mating direction, or an X-direction. As understood from the above explanation, in the present embodiment, the mating direction of the connector 100 and the mating connector 500 is perpendicular to or intersects with the predetermined direction in which each of the cables 600 extends as shown in FIG. 1. In addition, the mating direction of the present embodiment is referred to as a front-rear direction, too.

As shown in FIG. 12, the mating connector 500 has a mating fitting portion 505 which is mated with the connector 100. The mating fitting portion 505 is provided with two mating lock portions 510. Each of the mating lock portions 510 of the present embodiment is a protrusion which protrudes upward, or in a positive Z-direction.

Figure 2:
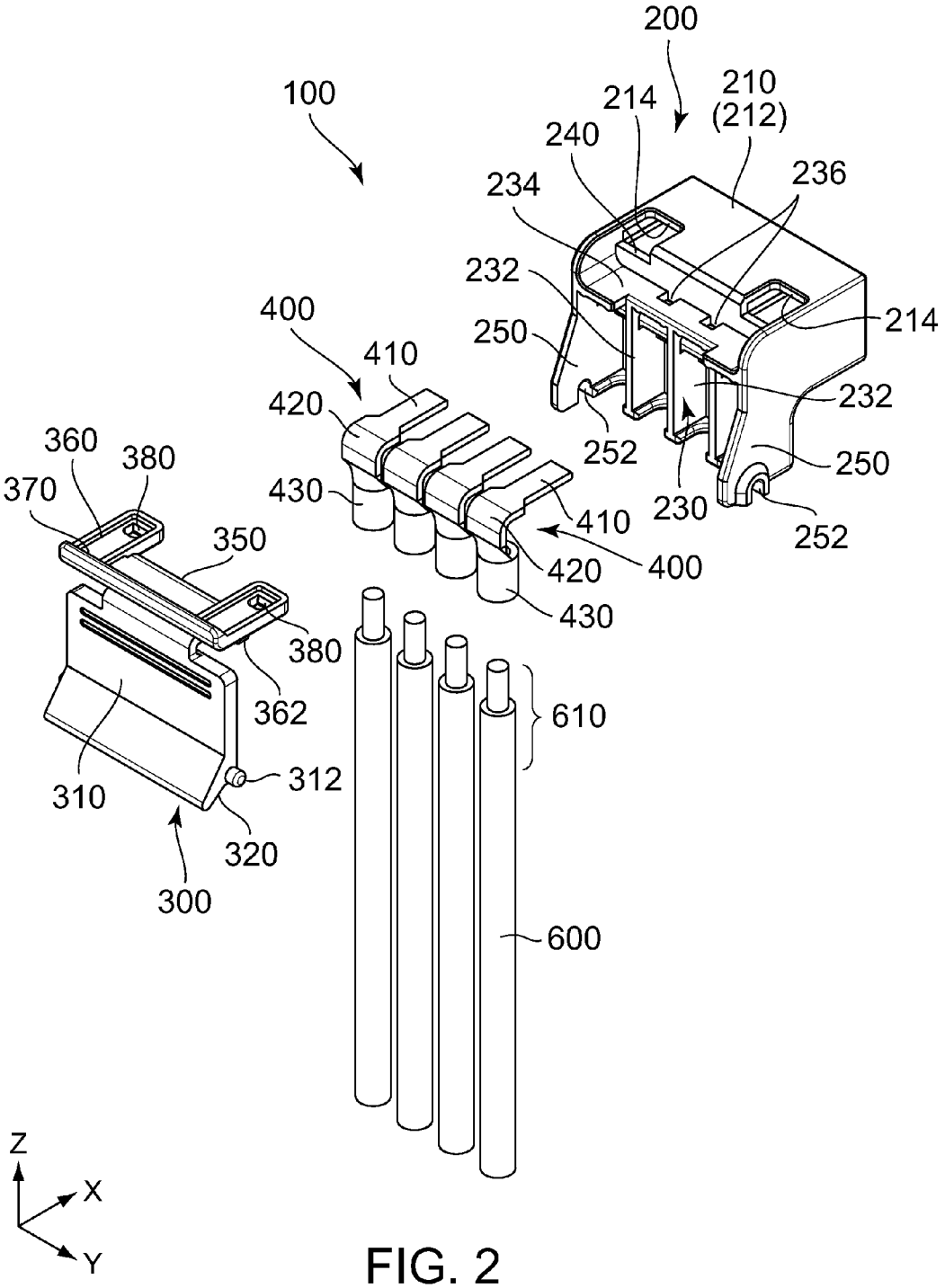
FIG. 2 is an exploded, perspective view showing the connector of FIG. 1.
Figure 5:
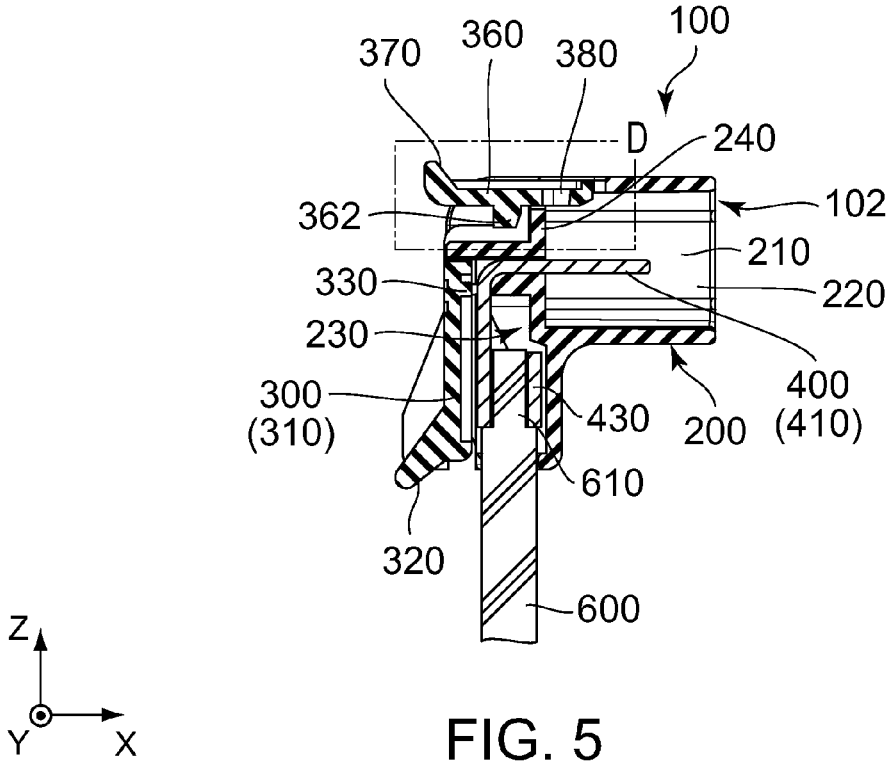
FIG. 5 is a cross-sectional view showing the connector of FIG. 3, taken along line A-A.
Figure 8:
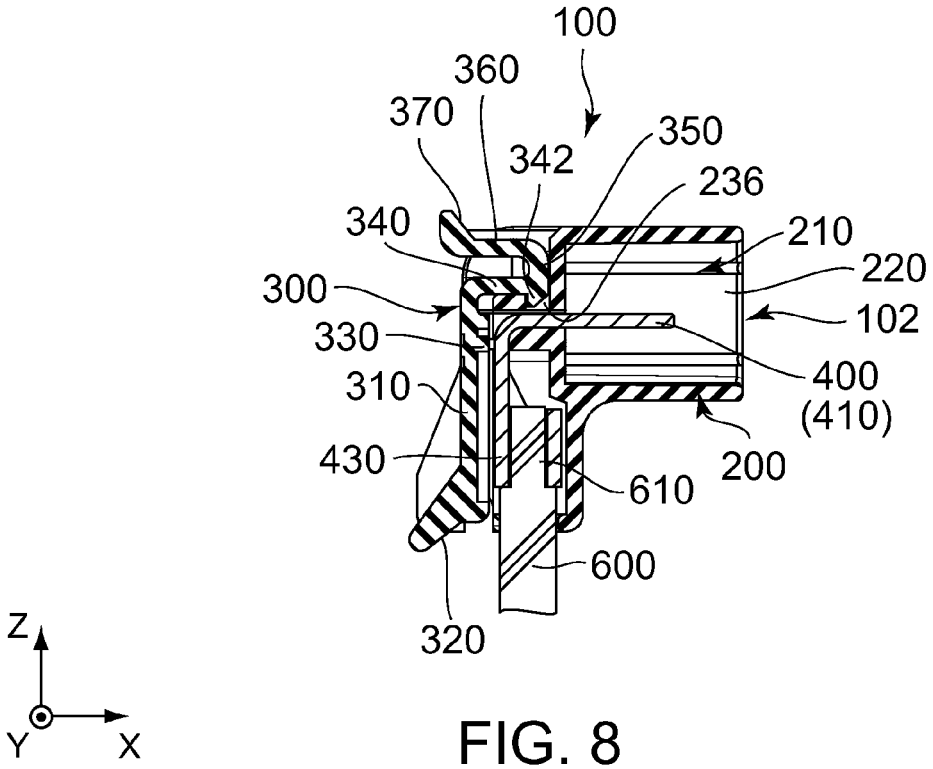
FIG. 8 is a cross-sectional view showing the connector of FIG. 3, taken along line C-C.

As shown in FIGS. 2, 5 and 8, the connector 100 comprises a first housing 200, a second housing 300 and four contacts 400. The first housing 200 is made of insulator. The second housing 300 is made of insulator. Each of the contacts 400 is made of conductor.

As shown in FIG. 2, each of the contacts 400 has a contact portion 410, a shoulder portion 420 and a cable holding portion 430. The contact portion 410 has a shape parallel to a horizontal plane, namely, a flat plate-like shape. The horizontal plane is an XY-plane. As shown in FIGS. 5 and 8, the cable holding portions 430 hold ends 610 of the cables 600, respectively, so that each of the cables 600 extends in the predetermined direction. As shown in FIG. 2, the shoulder portion 420 couples the contact portion 410 with the cable holding portion 430. As understood from the above explanation, the connector 100 of the present embodiment is a so-called angled connector. However, the present invention is not limited thereto. The connector 100 may be a so-called straight connector.

Figure 4:
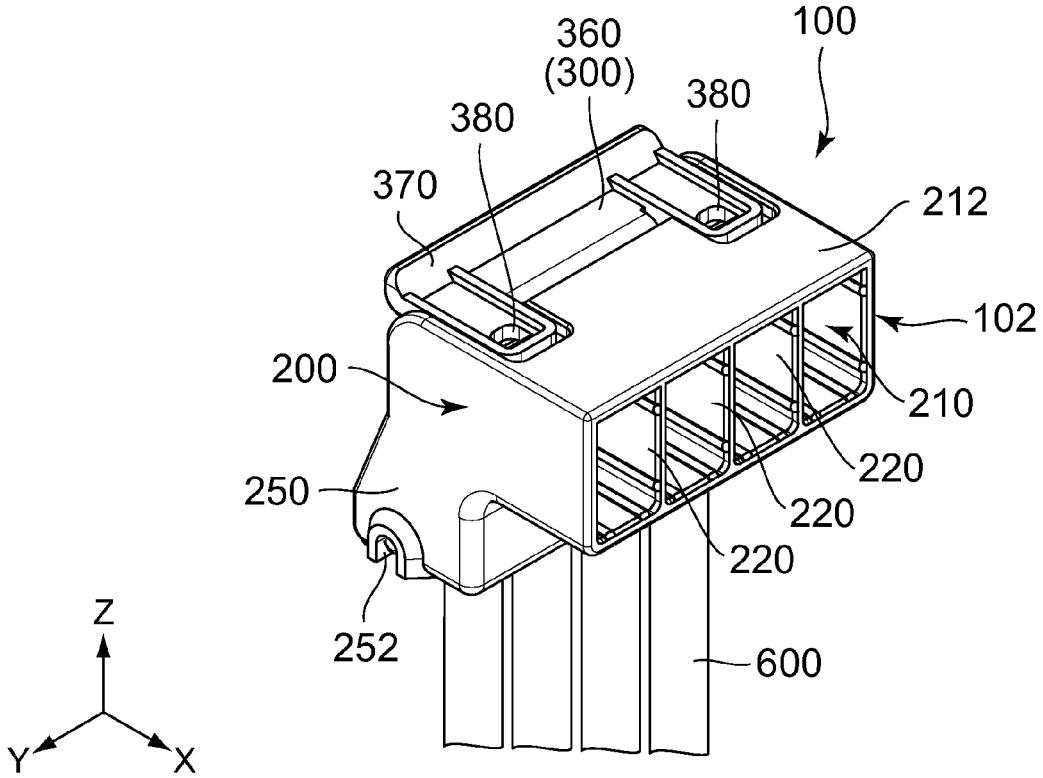
FIG. 4 is a front, perspective view showing the connector of FIG. 1.

With reference to FIGS. 2 and 4, the first housing 200 has a fitting portion 210 and an accommodation portion 230.

As shown in FIGS. 4, 5 and 8, the fitting portion 210 is opened at a front end 102, or a positive X-side end, of the connector 100. In addition, as shown in FIG. 4, partition walls 220 are provided inside the fitting portion 210 and divide the fitting portion 210 into four spaces. As described later, the four spaces correspond to the four contacts 400, respectively.

Figure 9:
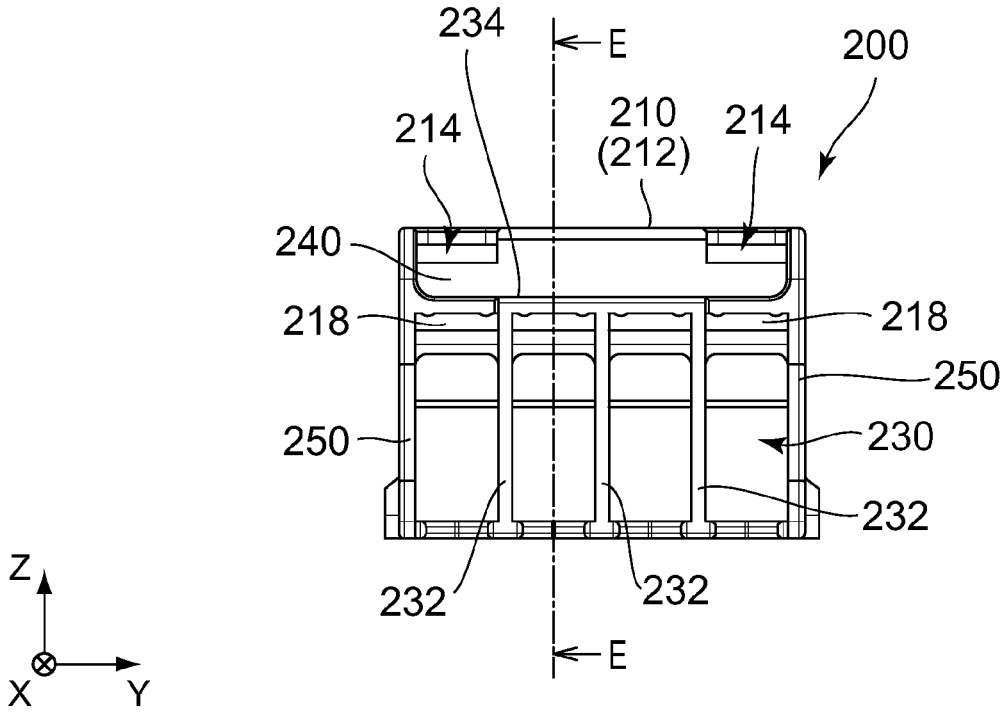
FIG. 9 is a rear view showing a first housing which is included in the connector of FIG. 1.

As shown in FIGS. 2 and 9, an upper portion 212 of the fitting portion 210 is formed with two openings 214. The openings 214 are provided so as to correspond to the mating lock portions 510, respectively, of the mating connector 500 of FIG. 12.

Figure 10:
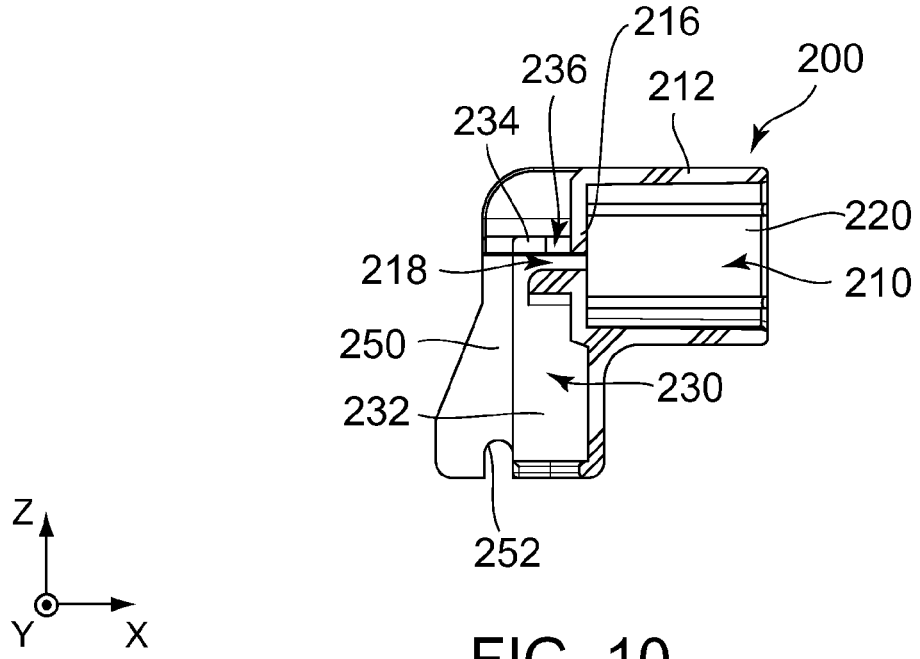
FIG. 10 is a cross-sectional view showing the first housing of FIG. 9, taken along line E-E.

As shown in FIGS. 2, 9 and 10, the accommodation portion 230 is opened rearward, or in a negative X-direction. As shown in FIGS. 2 and 9, partition walls 232 are provided inside the accommodation portion 230 and divide the accommodation portion 230 into four spaces. As described later, the four spaces correspond to the four contacts 400, respectively.

As shown in FIG. 10, a rear wall 216 of the fitting portion 210 is formed with insertion holes 218 each of which reaches the accommodation portion 230. The number of the insertion holes 218 is four. The insertion holes 218 correspond to the contacts 400, respectively. Each of the insertion holes 218 has an elongated, slit-like shape in a plane, or in a YZ-plane, perpendicular to the front-rear direction. As understood from FIGS. 5, 8 and 10, when each of the contact portions 410 is inserted into the corresponding insertion hole 218, each of the cable holding portions 430 is accommodated in the accommodation portion 230 while each of the contact portions 410 extends frontward in the fitting portion 210. Thus, each of the contacts 400 is, at least in part, accommodated in the first housing 200. As understood from FIGS. 2, 9 and 10, the accommodation portion 230 is opened rearward. Accordingly, each of the contacts 400 can be easily accommodated in the first housing 200 even after each of the contacts 400 is connected with the corresponding cable 600.

As shown in FIGS. 2 and 10, an upper portion 234 of the accommodation portion 230 is formed with two first upper engaging portions 236 each of which consists of a hole. In addition, first lower engaging portions 252 are provided at lower ends, or negative Z-side ends, of two side walls 250 of the accommodation portion 230, respectively. Each of the first lower engaging portions 252 consists of a recess which is recessed upward. Furthermore, as best illustrated in FIG. 2, there is a step difference between the upper portion 234 of the accommodation portion 230 and the upper portion 212 of the fitting portion 210. By using the step difference, a first positional regulating portion 240 is formed between the fitting portion 210 and the accommodation portion 230. The first positional regulating portion 240 of the present embodiment extends in a lateral direction, or a Y-direction.

The aforementioned first housing 200 is not essentially intended to be deformable. Accordingly, the first housing 200 is made of relatively solid material. In contrast, since the second housing 300 described below has a part which is resiliently deformable, it is preferable that the second housing 300 is made of material which is not harder than other material of which the first housing 200 is made. Accordingly, in the present embodiment, the first housing 200 is made of material harder than other material of which the second housing 300 is made. Thus, solidity of the first housing 200 and partial resiliency of the second housing 300 can simultaneously be achieved.

Figure 11:
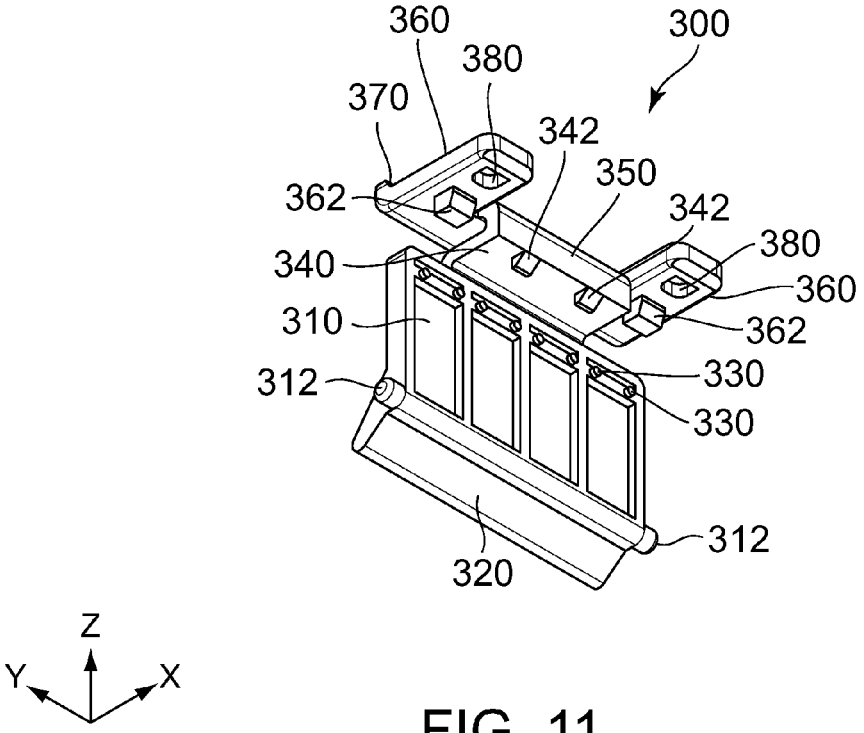
FIG. 11 is a perspective view showing a second housing which is included in the connector of FIG. 1.

As shown in FIGS. 2 and 5, the second housing 300 has a cover wall 310 which covers the accommodation portion 230. The cover wall 310 has a plate-like shape which roughly extends in parallel to a plane, or the YZ-plane, perpendicular to the front-rear direction. As shown in FIG. 11, two second lower engaging portions 312 are provided in the vicinity of a lower end of the cover wall 310. Each of the second lower engaging portions 312 protrudes outward in the lateral direction. The second lower engaging portions 312 correspond to the first lower engaging portions 252 (see FIG. 2), respectively.

As shown in FIGS. 2, 5, 7 and 8, the second housing 300 is provided with a hooked portion 320. As described later, the hooked portion 320 is a portion which is hooked by a finger when the connector 100 is released from the mating connector 500. The hooked portion 320 of the present embodiment is formed of a planar part which extends rearward and obliquely downward from the lower end of the cover wall 310. Specifically, since the hooked portion 320 intersects with both the mating direction, or the front-rear direction, and the predetermined direction, or the up-down direction, the hooked portion 320 can be easily hooked by a finger. In addition, under a state where each of the ends 610 of the cables 600 is held by the corresponding cable holding portion 430, the hooked portion 320 is positioned apart from the cables 600 in the mating direction, or in a perpendicular direction perpendicular to an extending direction in which each of the cables 600 extends. In particular, in the present embodiment, a distance from an end part of the hooked portion 320 to the cables 600 is equal or larger than a diameter of the cable 600. Accordingly, it is easy to insert a finger between the cables 600 and the hooked portion 320 so that the hooked portion 320 is easily hooked by a finger tip.

As shown in FIG. 11, a front surface of the cover wall 310 is formed with a plurality of holding protrusions 330. As shown in FIGS. 5 and 8, the holding protrusions 330 press the contacts 400 against the first housing 200 when the second housing 300 is attached to the first housing 200.

Figure 7:
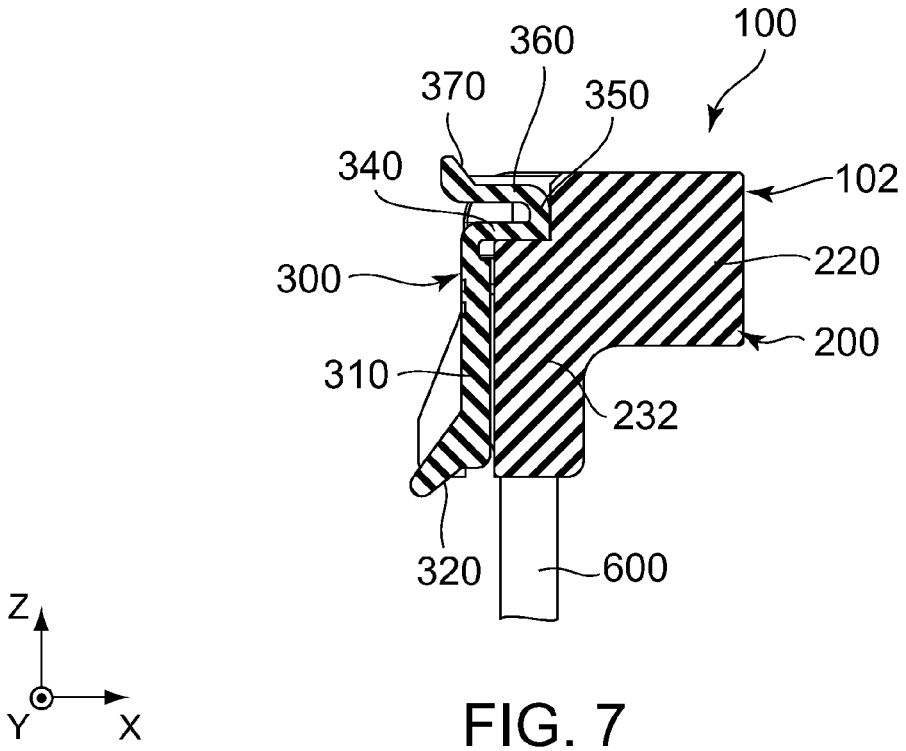
FIG. 7 is a cross-sectional view showing the connector of FIG. 3, taken along line B-B.

As shown in FIGS. 7 and 8, the second housing 300 further has a spring support portion 340, a spring portion 350 and a seesaw portion 360.

As shown in FIGS. 7, 8 and 11, the spring support portion 340 extends frontward from an upper end of the cover wall 310. As shown in FIG. 11, the spring support portion 340 is formed with two second upper engaging portions 342. Each of the second upper engaging portions 342 according the present embodiment is a protrusion which protrudes downward. When the second housing 300 is pivoted on the second lower engaging portions 312 after the second lower engaging portions 312 are engaged in the first lower engaging portions 252 (see FIG. 2) of the first housing 200, respectively, the second upper engaging portions 342 ride on the upper portion 234 (see FIG. 2) of the accommodation portion 230 and are then received in the first upper engaging portions 236, respectively (see FIG. 8). Thus, the second housing 300 is attached to the first housing 200. At that time, as shown in FIG. 8, the holding protrusions 330 press the contacts 400, which are accommodated in the accommodation portion 230, against the first housing 200 so that each of the contacts 400 is held by the first housing 200 and the second housing 300.

Figure 3:
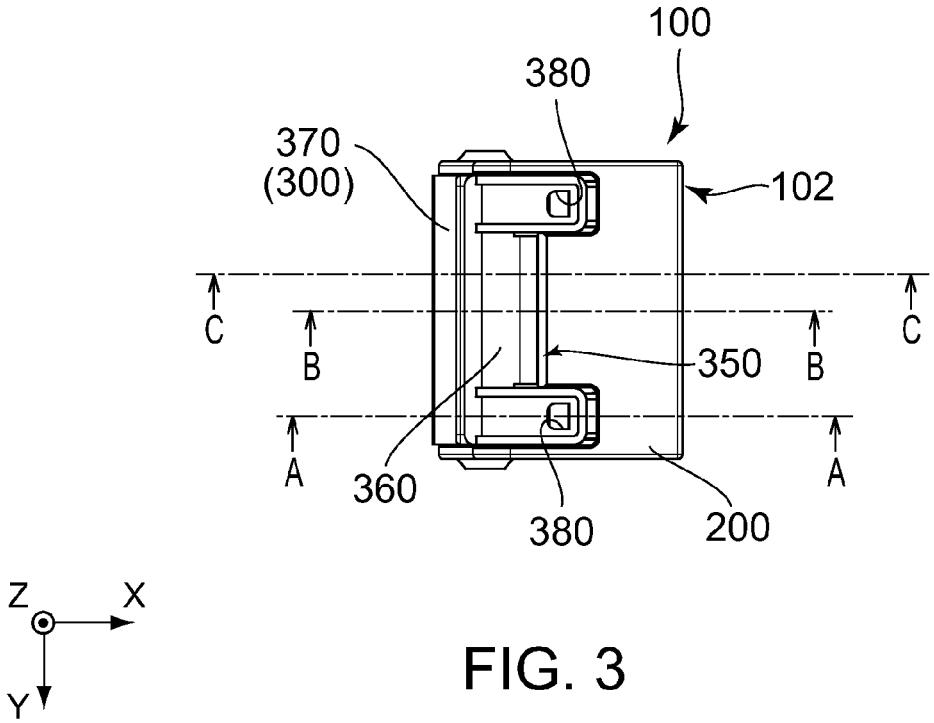
FIG. 3 is an upper view showing the connector of FIG. 1.

As shown in FIGS. 7, 8 and 11, the spring portion 350 is supported by the spring support portion 340. The spring portion 350 is resiliently deformable and supports the seesaw portion 360. As shown in FIG. 3, the seesaw portion 360 has a widened U-like shape when seen from above. As understood from FIGS. 3 and 11, the seesaw portion 360 has a front portion and a rear portion. The front portion is positioned frontward of the spring portion 350 and the rear portion is positioned rearward of the spring portion 350. The front portion is moved upward when the rear portion is moved downward. Specifically, the seesaw portion 360 is supported by the spring portion 350 so as to be movable in a seesaw manner. In other words, since the spring portion 350, which extends downward from approximately middle of the seesaw portion 360 in the lateral direction, functions as a fulcrum, the seesaw portion 360 is movable in a seesaw manner.

Figure 6:
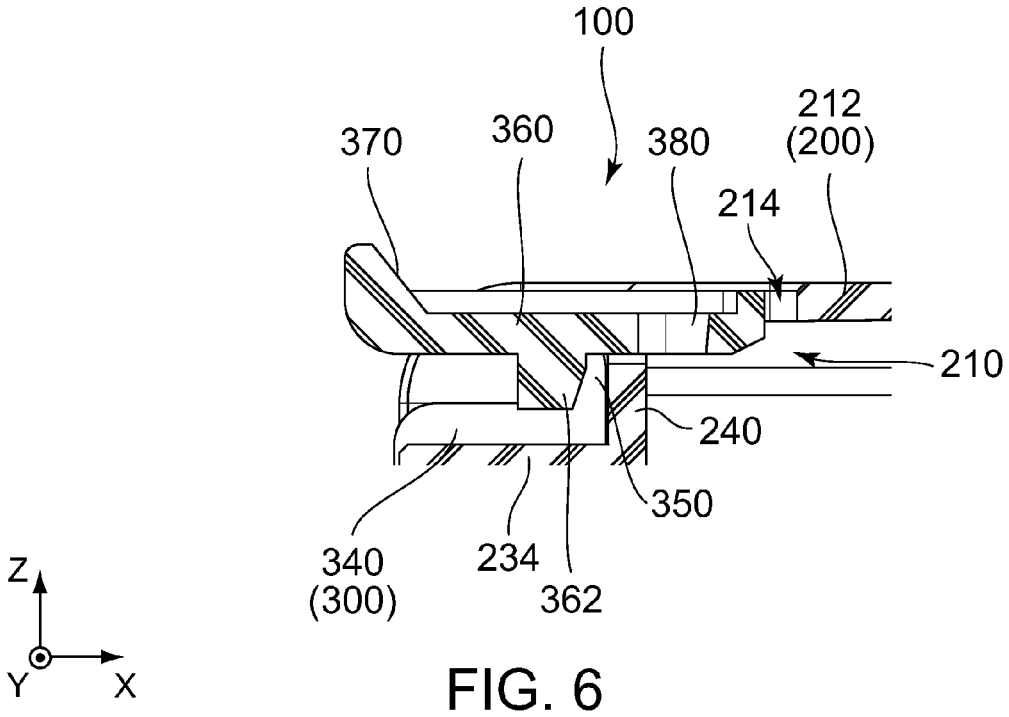
FIG. 6 is an enlarged view showing a part which is enclosed by a quadrangle D of dashed-dotted lines of FIG. 5.

As shown in FIG. 11, the seesaw portion 360 is formed with second positional regulating portions 362, an operation portion 370 and lock portions 380. Specifically, the operation portion 370 and the lock portions 380 are supported by the spring portion 350. As shown in FIG. 6, in the front-rear direction, or in the mating direction, each of the second positional regulating portions 362 is positioned at a position which is positioned slightly rearward of the spring portion 350 and positioned at almost the same position as the spring portion 350. The operation portion 370 is formed of a surface of the seesaw portion 360 which is positioned rearward of the spring portion 350. The lock portions 380 are formed of holes of the seesaw portion 360 each of which is positioned frontward of the spring portion 350. Because of the aforementioned positional relation between the operation portion 370 and the lock portions 380, each of the lock portions 380 is moved upward when the operation portion 370 is operated to be pressed downward. As understood from FIGS. 12 to 14, when each of the lock portions 380 is moved upward, the operation portion 370 is moved downward.

As shown in FIG. 11, the number of the second positional regulating portions 362 of the present embodiment is two. As shown in FIG. 6, each of the second positional regulating portions 362 is positioned rearward of the first positional regulating portion 240 and faces the first positional regulating portion 240 in the front-rear direction. Accordingly, even if a large frontward force, namely, a large force toward the first housing 200, is applied to the seesaw portion 360, each of the second positional regulating portions 362 abuts the first positional regulating portion 240 to stop an excessive movement of the seesaw portion 360 so that the spring portion 350 can be prevented from being broken.

As understood from FIGS. 12 and 14, when the connector 100 is mated with the mating connector 500, the lock portions 380 lock the mating lock portions 510, respectively. As described above, in the present embodiment, each of the mating lock portions 510 is a protrusion, and each of the lock portions 380 is the corresponding hole. As understood from FIGS. 2 and 6, when the second housing 300 is attached to the first housing 200, the lock portions 380 are positioned in the openings 214, respectively, which are provided on the upper portion 212 of the fitting portion 210. Accordingly, when the mating fitting portion 505 of the mating connector 500 (see FIG. 12) is inserted into the fitting portion 210 of the connector 100, the mating lock portions 510 which are provided on the mating fitting portion 505 of the mating connector 500 (see FIG. 12) can lock the lock portions 380 in the openings 214, respectively. Since each of the lock portions 380 is positioned at a position different from a position of the spring portion 350 in the mating direction as described above, the openings 214 may be provided so as to correspond only to the lock portions 380, respectively. Accordingly, each of the openings 214 which are formed on the first housing 200 can have a relatively reduced size so that the first housing 200 can be secured to have a required strength.

Figure 15:
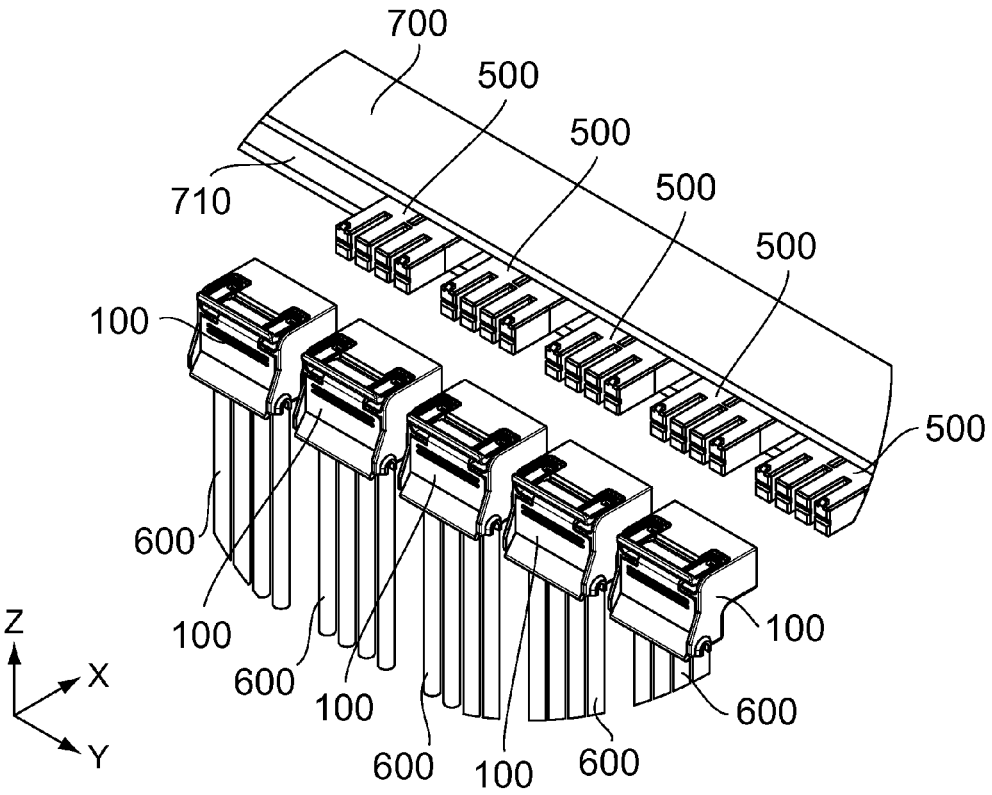
FIG. 15 is a perspective view showing the connectors and the mating connectors which are arranged in a row. Each of the connectors and the mating connectors is in the unmated state.
Figure 16:
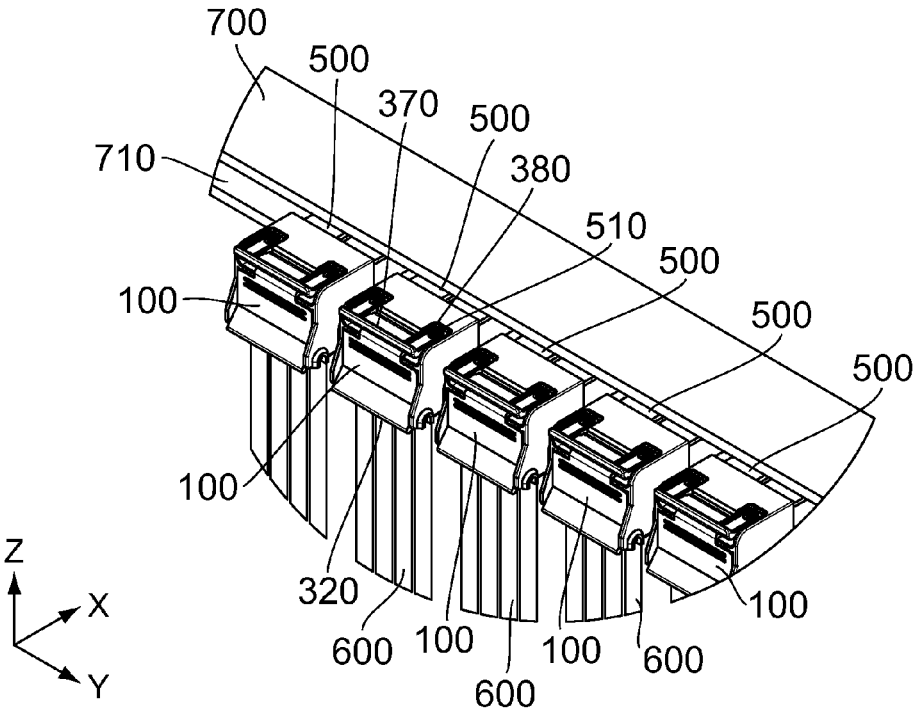
FIG. 16 is another perspective view showing the connectors and the mating connectors of FIG. 15. Each of the connectors and the mating connectors is in the mated state.
Figure 17:
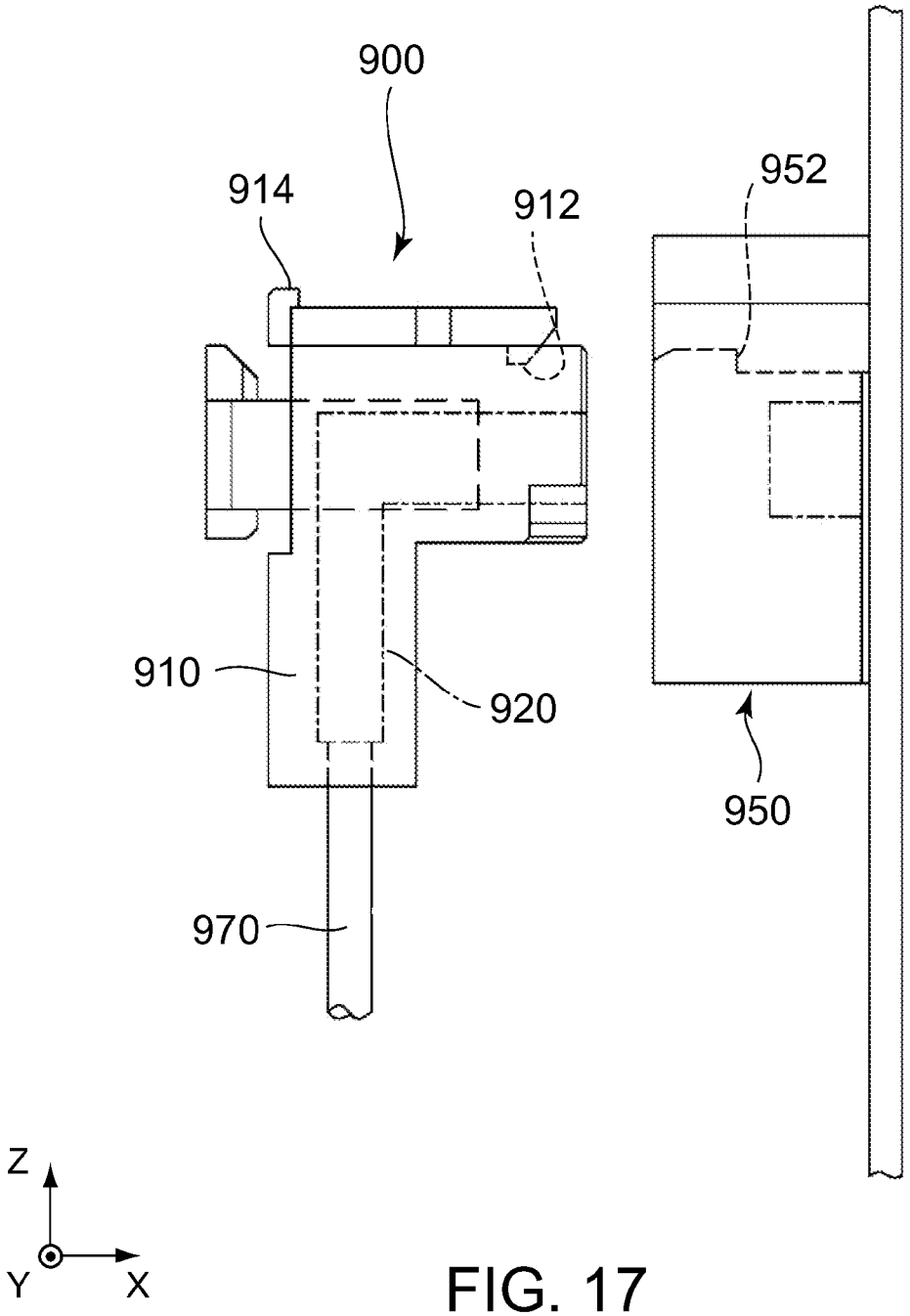
FIG. 17 PRIOR ART
FIG. 17 is a view showing a connector and a mating connector of Patent Document 1.

As shown in FIG. 1, the operation portion 370 is positioned apart from the hooked portion 320 in the predetermined direction. The surface, of which the operation portion 370 is formed, extends rearward and obliquely upward at a rear end of the seesaw portion 360. Specifically, the operation portion 370 intersects with both the mating direction, or the front-rear direction, and the predetermined direction, or the up-down direction, so that the operation portion 370 is easily operatable. When the operation portion 370 is pressed by a finger to be moved toward the hooked portion 320, or moved downward, under a state where the hooked portion 320 is hooked by another finger, each of the lock portions 380 can be moved upward. As understood from FIGS. 12 to 14, when the operation portion 370 is operated so as to be moved toward the hooked portion 320, locks of the lock portions 380 against the mating lock portions 510 are released so that the connector 100 can be released from the mating connector 500. As understood from FIG. 1, when the operation portion 370 is operated so as to be moved toward the hooked portion 320, the fingers of an operator are positioned rearward of the connector 100 and are apart from the cable 600. Accordingly, for example, in a state where a plurality of the connectors 100 are mated with a plurality of the mating connectors 500 which are attached between two busbars 700 and 710 to be arranged in a row as shown in FIGS. 15 and 16, one of the connectors 100 can be released from and mated with the mating connector 500 corresponding thereto while the remaining connectors 100 and the cables 600 do not obstruct the release operation and the mate operation.

While the present invention has been described with specific embodiments, the present invention is not limited thereto but may be modified in various manners.

In the aforementioned embodiment, the mating direction of the connector 100 and the mating connector 500 is perpendicular to the extending direction of the cable 600. However, the present invention is not limited thereto. The mating direction of the connector 100 and the mating connector 500 may be same as the extending direction of the cable 600. Considering operability of the connector 100 upon the release of the connector 100 from the mating connector 500, it is preferable that the mating direction is perpendicular to the extending direction of the cable 600 similar to the present embodiment.

Although the number of the contacts 400 of the aforementioned embodiment is four, the present embodiment is not limited thereto. The number of the contacts 400 may be three or less than three. In addition, the number of the contacts 400 may be five or more than five.

In the aforementioned embodiment, each of the mating lock portions 510 is the protrusion and each of the lock portions 380 is the hole. However, the preset invention is not limited thereto. Each of the mating lock portions 510 may be a hole while each of the lock portions 380 may be a protrusion. In a case where each of the mating lock portions 510 is the protrusion while each of the lock portions 380 is the hole similar to the present embodiment, mating contacts (not shown) which are included in the mating connector 500 are not exposed outward so that the mating connector 500 has a structure suitable to use as a power supply connector. Accordingly, if the mating connector 500 is used as a power supply connector, it is preferable that each of the lock portions 380 is the holes. Alternatively, it is at least preferable that the lock portions 380 are recesses which correspond to the protrusions of the mating lock portions 510, respectively.

The present application is based on a Japanese patent application of JP2014-153435 filed before the Japan Patent Office on Jul. 29, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector which has a mating lock portion, the connector comprising a first housing, a second housing and a contact, wherein:

the first housing accommodates, at least in part, the contact;

the contact is provided with a cable holding portion which holds an end of a cable so that the cable extends in a predetermined direction;

the second housing is attached to the first housing to hold the contact in cooperation with the first housing;

the second housing is provided with a hooked portion, a spring portion, an operation portion and a lock portion;

the spring portion is resiliently deformable;

the operation portion and the lock portion are supported by the spring portion;

the lock portion locks the mating lock portion when the connector and the mating connector are mated with each other;

the hooked portion is a portion which is hooked by a finger upon operation of the operation portion;

the hooked portion is positioned apart from the operation portion in the predetermined direction;

the operation portion releases a lock of the lock portion against the mating lock portion when operated to be moved toward the hooked portion;

the second housing is provided with a seesaw portion which is supported by the spring portion;

the operation portion and the lock portion are provided on the seesaw portion;

the first housing is provided with a first positional regulating portion;

the seesaw portion is provided with a second positional regulating portion;

the second positional regulating portion faces the first positional regulating portion; and when a force toward the first housing is applied to the seesaw portion, the second positional regulating portion abuts the first positional regulating portion to regulate a movement of the seesaw portion.

2. The connector as recited in claim 1, wherein:

the connector is mated with the mating connector along a mating direction; and the predetermined direction and the mating direction intersect with each other.

3. The connector as recited in claim 1, wherein:

the hooked portion intersects with both a perpendicular direction and the predetermined direction;

the perpendicular direction is perpendicular to the predetermined direction; and the hooked portion is positioned apart from the cable in the perpendicular direction under a state where the end of the cable is held by the cable holding portion.

4. The connector as recited in claim 1, wherein:

the operation portion intersects with both a perpendicular direction and the predetermined direction; and the perpendicular direction is perpendicular to the predetermined direction.

5. The connector as recited in claim 1, wherein the first housing is made of material harder than another material of which the second housing is made.

6. The connector as recited in claim 1, wherein:

the connector is mated with the mating connector along a mating direction; and the lock portion and the spring portion are positioned at positions different from each other in the mating direction.

7. The connector as recited in claim 1, wherein:

the mating lock portion is a protrusion; and the lock portion is a hole which corresponds to the protrusion of the mating lock portion.

8. The connector as recited in claim 1, wherein:

the second housing is provided with a holding protrusion; and the holding protrusion presses the contact against the first housing so that the contact is held by the first housing and the second housing.

* * * * *